United States Patent [19]

Ishizaki

[11] 4,103,491

[45] Aug. 1, 1978

[54] STIRLING CYCLE MACHINE

[76] Inventor: Yoshihiro Ishizaki, 702 Yamanouchi, Kamakura, Japan

[21] Appl. No.: 790,904

[22] Filed: Apr. 26, 1977

[30] Foreign Application Priority Data

Apr. 28, 1976 [JP] Japan ..... 51-48802

[51] Int. Cl.[2] ..... F02G 1/04

[52] U.S. Cl. ..... 60/519; 60/525

[58] Field of Search ..... 60/517, 518, 519, 520, 60/525, 526; 62/6

[56] References Cited

U.S. PATENT DOCUMENTS

| | | | |
|---|---|---|---|
| 3,487,424 | 12/1969 | Leger | 62/6 |
| 3,537,269 | 11/1970 | Kelly | 62/6 |
| 3,763,649 | 10/1973 | Wahnschaffe | 60/519 |
| 4,009,573 | 3/1977 | Satz | 60/526 X |

*Primary Examiner*—Allen M. Ostrager
*Attorney, Agent, or Firm*—Finnegan, Henderson, Farabow & Garrett

[57] ABSTRACT

A Stirling cycle machine comprises a normal temperature housing having a rotor disposed therein to define normal temperature chambers therein. The machine further includes a high or low temperature housing having a rotor disposed therein to define high or low temperature chambers therein. Passages are provided between the normal temperature chambers and the high or low temperature chambers by means of a heat exchanger and a regenerator which are connected to the rotors to rotate therewith in unison. The passages in the regenerator is connected with the high or low temperature chambers through a plurality of passages by use of slide valves formed in the high or low temperaturehousing.

11 Claims, 10 Drawing Figures

STIRLING CYCLE MACHINE

The present invention relates to a Stirling cycle machines which can be operated as engines, refrigerator units and heat generating units.

Stirling cycle machines are known as machines in which isovolumetric changes and isothermal changes are repeatedly effected from the viewpoint of thermodynamics. A reciprocating type of the Stirling cycle machines, in which all of moving parts conduct reciprocating movements, have been developed. Such receiprocating type machines are considered disadvantageous in respect of a number of parts required for constructing the machines, weight of the machines and vibrations or other troubles which may be encountered in operation. Further, the reciprocating type machine are complicated in structure. The U.S. Pat. Nos. 3,487,424 and 3,537,269 disclose the Stirling cycle machines in which some of moving elements are driven in a rotational motion. However, the machines as disclosed in these patents still includes non-rotational moving elements.

The present invention has therefore an object to provide a Stirling cycle machine in which substantially all of moving elements are arranged for rotational motion.

Another object of the present invention is to provide a Stirling cycle machine in which rotary slide valves are employed to communicate a heat exchanger with low or high temperature chambers formed in a housing therefor.

A further object of the present invention is to provide a Stirling cycle machine which is simple in structure as compared with the conventional machines and in which improvements are made in respect of the number of parts, compactness and the weight of the machine.

According to the present invention, the above and other objects can be accomplished by a Stirling cycle machine comprising first housing means having first cavity means formed therein, first rotor means disposed in said first cavity means in the first housing means for defining first chamber means together with the first housing means, said first chamber means having a volume variable in response to rotation of said first rotor means, second housing means having second cavity means formed therein, second rotor means disposed in said second cavity means in the second housing means for defining second chamber means together with the second housing means, said second chamber means having a volume variable in response to rotation of said second rotor means, means for connecting said first and second rotor means so that they are simultaneously rotated, passage means for connecting the first chamber means with the second chamber means with a predetermined phase difference, regenerator means provided in said passage means, means provided adjacent to the first chamber means for maintaining the first chamber means at a substantially constant temperature, said passage means including a plurality of passages between the regenerator means and the second chamber means.

According to a preferable aspect of the present invention, the first chamber means includes a plurality of first chambers and the second chamber means also includes the same number of second chambers. The passage means further includes a corresponding number of separated passages which connect the first chambers respectively with the second chambers which are in different phase positions. The passages are arranged in heat exchange relationship by heat exchanger means.

In a preferable arrangement of the present invention, the heat exchanger means includes a heat exchanger housing which is connected with the first and second rotor means to rotate therewith.

Preferably, the heat exchanger housing is disposed in the hollow space in the first rotor means. The space in the rotor means may be used as a jacket for coolant. The heat exchanger housing is further formed at its external surface with spiral ridge means which functions to drive the cooling medium and to increase the efficiency of the cooling.

The above and other objects and features of the present invention will become apparent from the following descriptions of preferred embodiments taking reference to the accompanying drawings, in which.

Figure 6A:
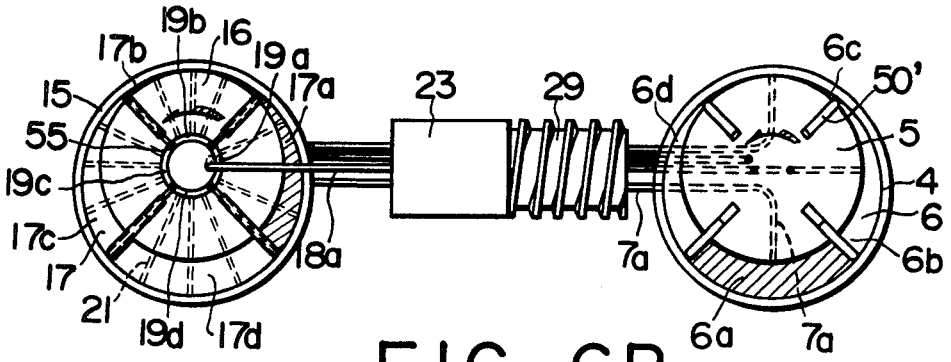
Figure 6B:
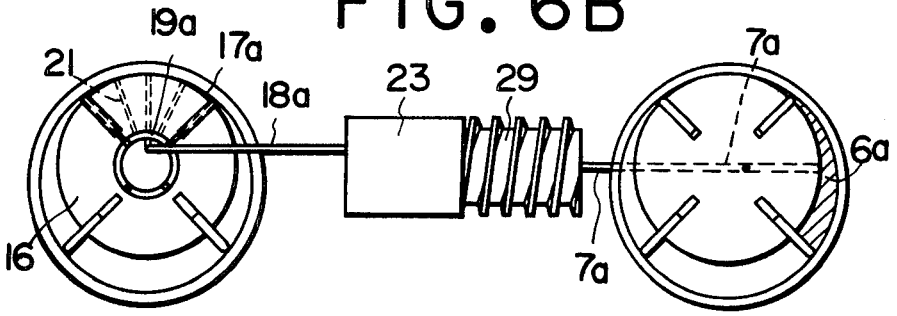
Figure 6C:
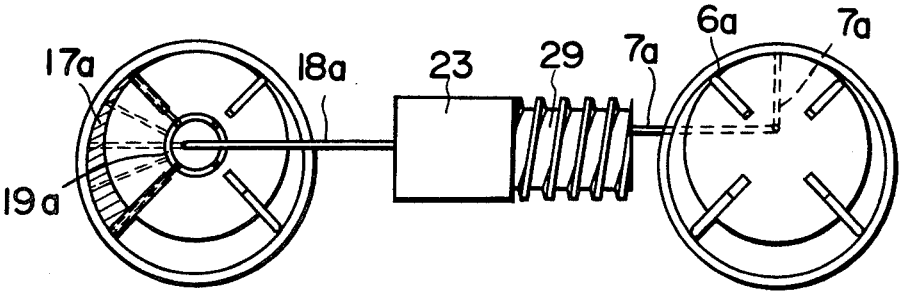
Figure 6D:
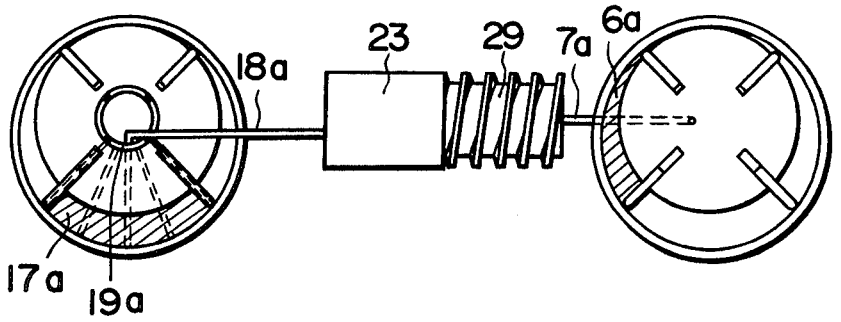
Figure 7:
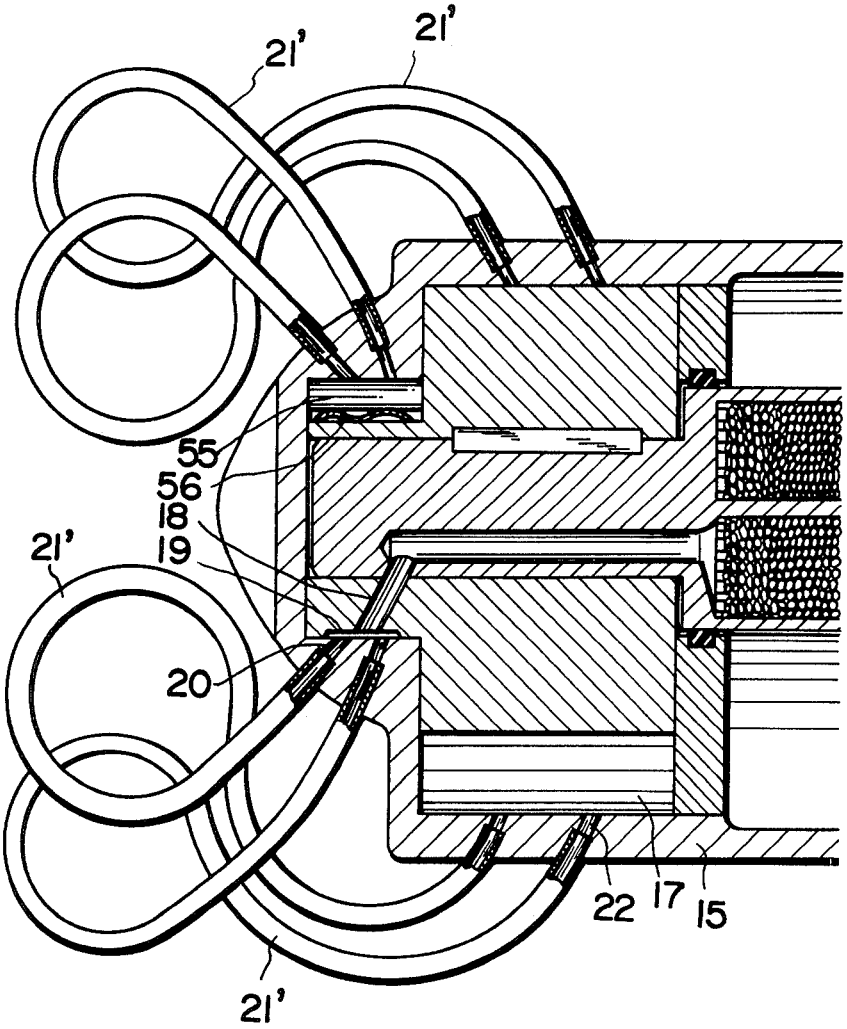

FIGS. 6 (A) through (D) schematically show the operation of the machine in accordance with the present invention; and, FIG. 7 is a fragmentary sectional view showing another embodiment of the present invention.

Figure 1:
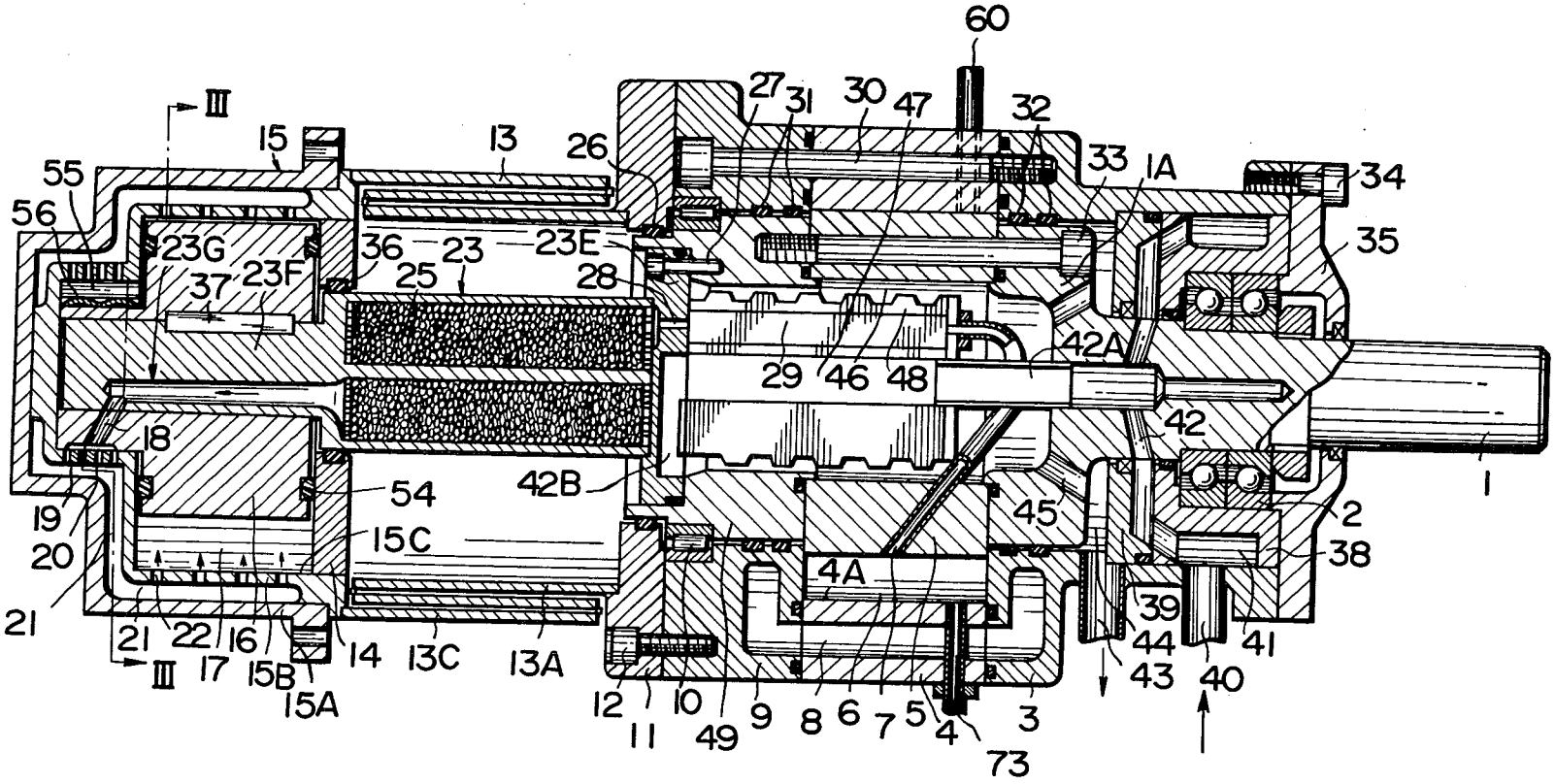
FIG. 1 is a longitudinal sectional view of a Stirling cycle machine in accordance with one embodiment of the present invention.

Referring now to the drawings, particularly to FIG. 1, a Stirling cycle machine shown therein comprises a hollow housing 4 having a cylindrical cavity 4*a* therein. Two side housings 3 and 9 are secured by means of connecting balts 30 to the opposite sides of the rotor housing 4. In the cavity 4*a* of the housing 4, there is rotatably disposed a rotor 5. Within the side housing 9, there is disposed a hollow heat exchanger housing 49 with fluid seals 31 interposed therebetween. The rotor 5 and the heat exchanger housing 49 are connected by means of connecting bolts 33 with a power transmitting shaft 1. In this embodiment, the shaft 1 has a flange 1A at its inner end and the connecting bolts 33 passes through the flange 1A, however, it should be noted that shaft 1 may be connected with the rotor 5 by any other means. Alternatively, the shaft 1 may be formed integrally with the rotor 5.

In the side housing 3, there is disposed a bearing casing 38 and a partition alate 39 which are secured in position by an end plate 35 attached to the side housing 3 by means of connecting bolts 34. The bearing casing 38 carries bearings 2 which rotatably supports the shaft 1.

As schematically shown in FIG. 6, the rotor 5 is disposed eccentrically in the cavity 4A and carries four equi-distantly disposed vanes 50 so as to define working chambers 6 of which volume changes in response to rotation of the rotor 5.

As illustrated in FIG. 1, heat exchanger housing 49 is supported in the side housing 9 for rotation by a bearing 10 and fluid seals 32 are disposed between the side housing 3 and the flange 1A of the shaft 1.

Within the hollow interior of the rotor 5 and the heat exchanger housing 49, there is disposed a heat exchanger 29. The heat exchanger 29 has a plurality of fluid passages which are in heat exchanging relationship with each other and each of which is connected through a conduit 7 with one of the working chambers 6.

Adjacent to the heat exchanger 29, there is provided a regenerator 23 which has end flange 23E connected through bolts 27 with the heat exchanger housing 49. The heat exchanger 29 is also secured to the end flange 23E of the regenerator 23 and the passages in the heat exchanger 29 are connected through passages 28 formed in the end flange 23E with the interior of the regenerator 23. Thus, it will be understood that the heat exchanger 29 and the regenerator 23 are rotatable in unison together with the rotor 5 and the exchanger housing 9.

The regenerator 23 is encircled by a thermally insulating sheath 13 which comprises three coaxial cylindrical members. Two outer members are connected together with at the right ends and two inner ends at the left ends as viewed in FIG. 1. The innermost member is connected at right end with a plate 11 which is in turn connected by means of connecting bolts 12 with the side housing 9. The sheath disclosed in U.S. Pat. No. 3,366,135 may be used for this machine.

Adjacent to the regenerator 23, there is disposed a second rotor housing 15 which comprises an outer housing member 15A and an inner housing member 15B. The inner housing member 15B has a cylindrical cavity 15C in which a second rotor 16 is disposed and held in position by a side plate 14. As shown in FIG. 1, the regenerator 23 has an axial extension 23F which is inserted into the rotor 16 and secured thereto by means of a key 37.

Figure 2:
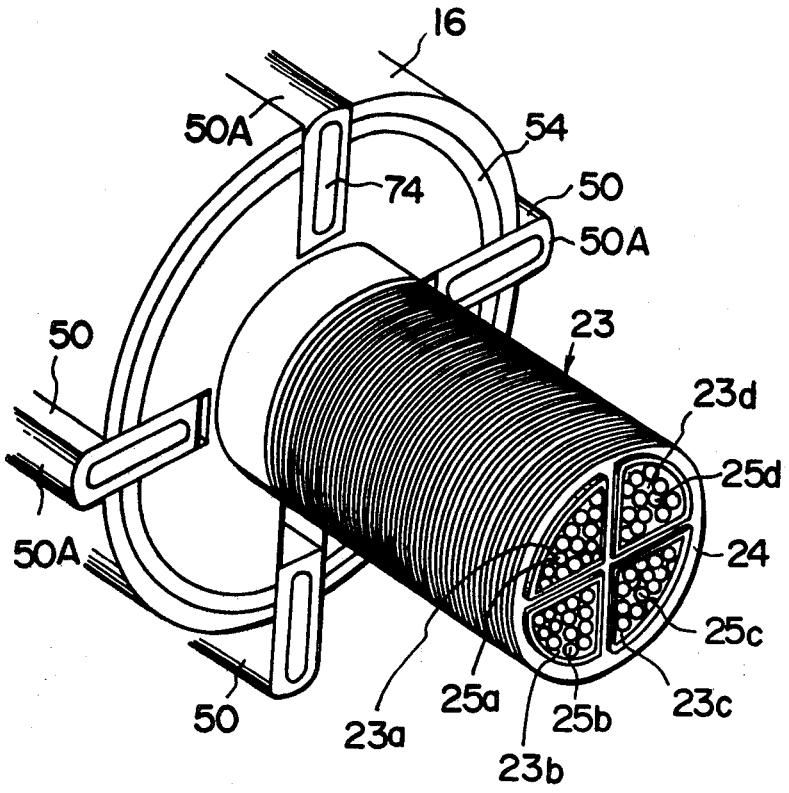
FIG. 2 is a perspective view showing the details of the regenerator employed in the machine shown in FIG. 1.

Referring to FIG. 2, it will be noted that the rotor 16 carries four radially extending vanes 50 so that soaking chamber 17 is defined in the cavity 15C. As in the case of the working chamber 6, the working chambers 17 also change in volume in response to a rotation of the rotor 16. It should also be noted that the rotor 16 is rotated together with the rotor 5.

Referring to FIG. 2, it will be seen that the regenerator 23 comprises a plurality of superimposed metal sheets 24 having four openings so that four axial passages 23*a*, 23*b*, 23*c* and 23*d* are defined therein. In the passages 23*a* through 23*d*, there are disposed heat accumulating matrix 25*a* through 25*d*.

The passages 23*a* through 23*d* of the regenerator 23 are respectively connected the passages 28 in the end flange 23E with corresponding passages in the heat exchanger 29.

Figure 3:
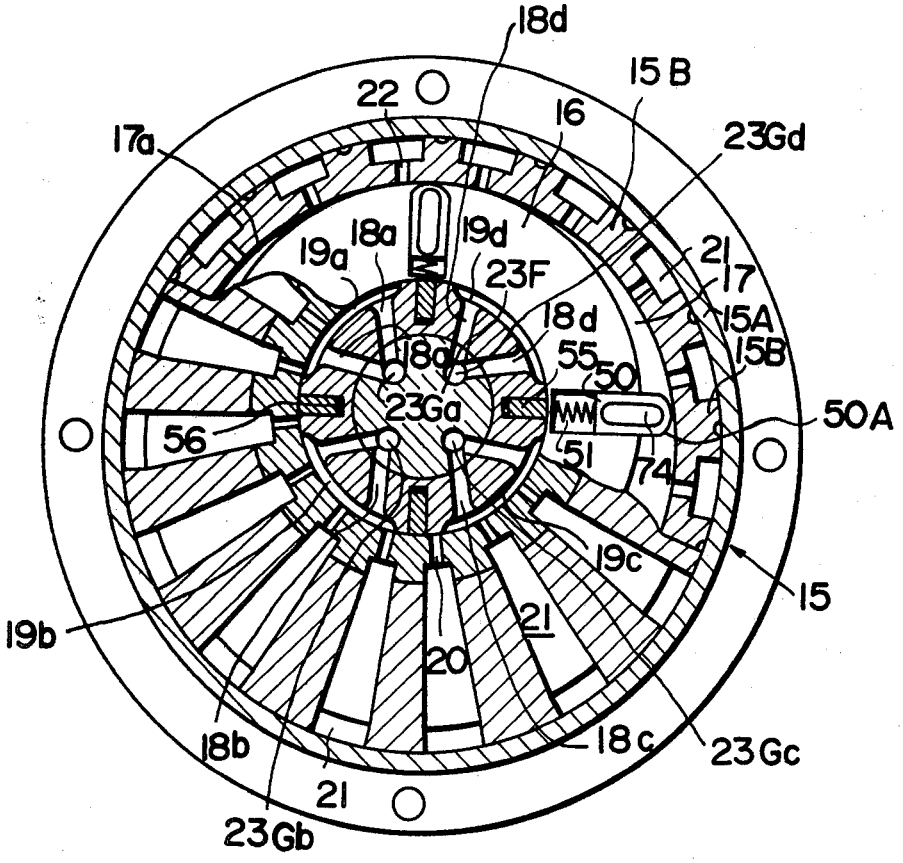
FIG. 3 is a cross-sectional view taken substantially along the line III—III in FIG. 1.

Referring to FIG. 3, the regenerator 23 is formed at its extension 23F with axial passages 23G one for each of the passages 23*a* through 23*d*. The rotor 16 is provided at end boss portion with radial passages 18*a* through 18*d* which are in communication respectively with corresponding axial passages 23G*a* to 23G*d* in the regenerator 23 and opening respectively to circumferential grooves 19*a* to 19*d*. The circumferential grooves are separated from each other by means of sealing plate 55 which are biased radially outwardly by springs 56.

Between the outer and inner members 15A and 15B of the second rotor housing 15, there are provided a plurality of separated flow passages 21 which are at one end brought cylindrically into communication through apertures 20 formed in the inner housing member 15B with grooves 19*a* through 19*d* and at the other end cylindrically into communication through apertures 22 bored in the inner housing 15B with the working chambers 17.

A cooling fluid passage 41 is formed between the bearing casing 38 and the partition plate 39 and the passage 41 is on one hand connected with a cooling fluid inlet pipe 40 and on the other hand with radial passages 42 formed in the shaft 1. The radial passages 42 are in communication with an axial passage 42A which pass through the heat exchanger 29 and is connected with a groove 42B formed in the end flange 23E of the regenerator 23. The groove 42B is opened to the space 46 in the rotor 5 and the heat exchanger housing 49 around the heat exchanger 29. This space is in turn connected through passages 45 formed in the flange 1A of the shaft 1 and a space 44 formed between the flange 1A and the partition plate 39 with a cooling fluid outlet 43. The heat exchanger 29 is formed at its outer surface with a spiral ridge 48. Thus, a flow of cooling fluid is maintained from the inlet 40 through the passages 41 and 42 and further through the axial passage 42A and the radial groove 42B, the space 46, the passages 45 and 44 into the outlet 43. The spiral ridge 48 on the heat exchanger 29 serves to drive the fluid in the space 46 toward the passage 45. A further cooling water jacket 8 is formed in the housing 4 and the side housings 3 and 9.

Figure 4:
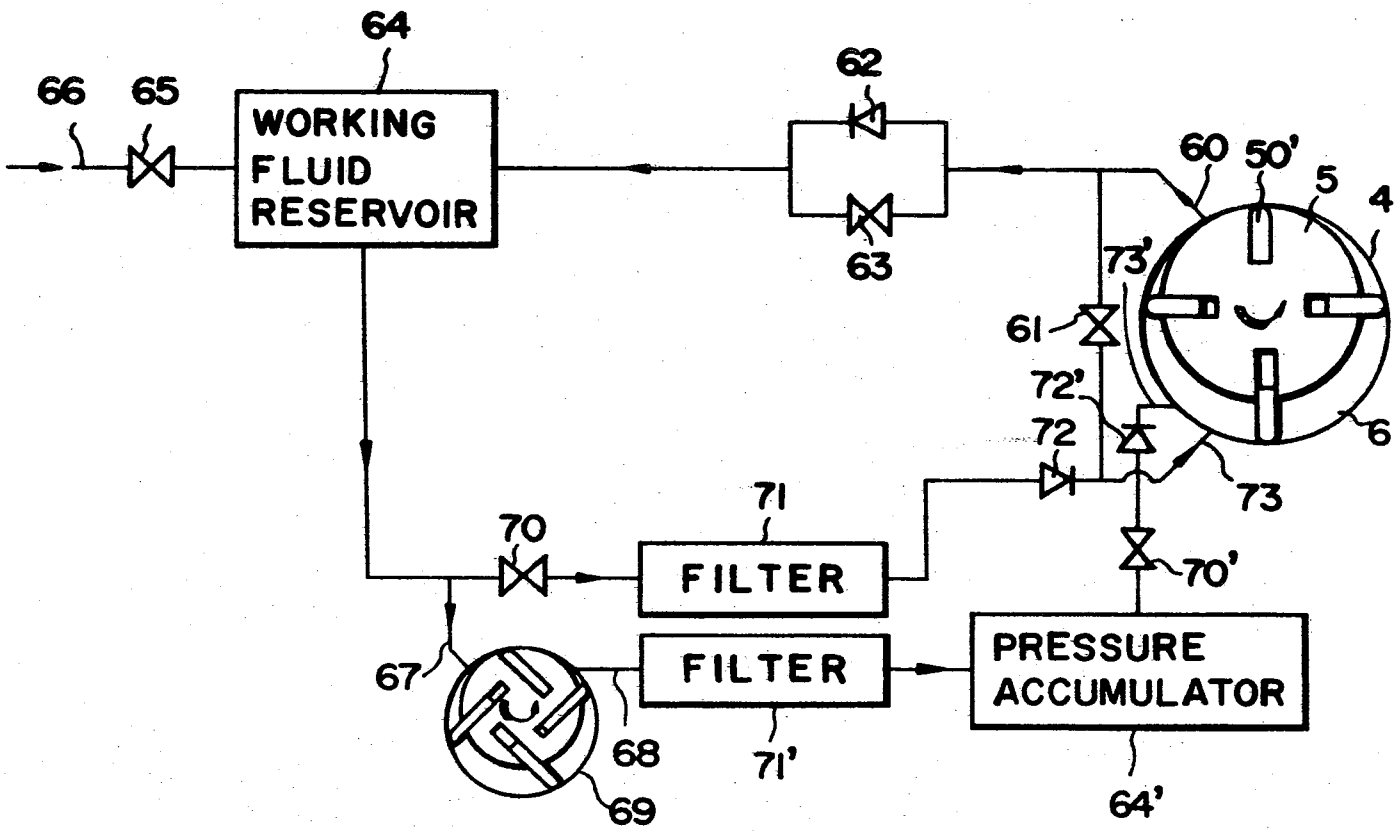
FIG. 4 is a diagram schematically showing the flow circuit of the machine shown in FIG. 1.

Referring now to FIG. 4 which shows a circuit for supply and pressure control of working fluid, the rotor housing 4 is formed with a discharge port 60 which is connected, through a high pressure check valve 62 and a pressure limiting valve 63 parallel to the valve 62, to a warking fluid reservoir 64. The discharge port 60 is lacated at a portion to open to one of the working chambers 6 which is in a maximum pressure portion.

The rotor housing 4 is further formed with an inlet port 73 at a position to open to another working chamber 6 which is in a minimum pressure position. The reservoir 64 is connected through a pressure regulating valve 70, a filter 71 and a low pressure check valve with the inlet port 73. Further, the reservoir 64 may be connected with an inlet of a pump 69 which has an outlet 68 connected through a filter 71', a pressure accumulator 64', a shut-off valve 70' and a check valve 72' with a further inlet port 73' in the housing 4. When the Stirling cycle machine is employed in an automobile, the pump 69 may be actuated, for example, by a brake actuating pedal of the automobile so that the working fluid is supplied under an increased pressure to the pressure accumulator 64' when the automobile brake is actuated. The shut-off valve 70' may further be actuated in response to an actuation of an engine throttle valve of the automobile so that the valve 70' is opened when the engine throttle valve is opened for acceleration of the automobile to supply working fluid under an increased pressure.

The inlet port 73 and the outlet port 60 are connected together through a bypass valve 61. The fluid reservoir 64 is further provided with a fluid supply line 66 having a supply valve 65. Thus, it will be understood that the pressure in the working chambers 6 is suitably controlled by the check valves 61, 72 and 72'.

The Stirling cycle machines as described in the drawings is considered as conducting a Stirling cycle for each rotation of the rotors 5 and 16, said cycle including an isothermal compression stroke, an isovolumetric change stroke, an isothermal expansion stroke and an isovolumetric change stroke. In operation, a working fluid such as helium, hydrogen, air, fleon or other fluid or a mixture thereof is circulated in the machine.

Figure 5:
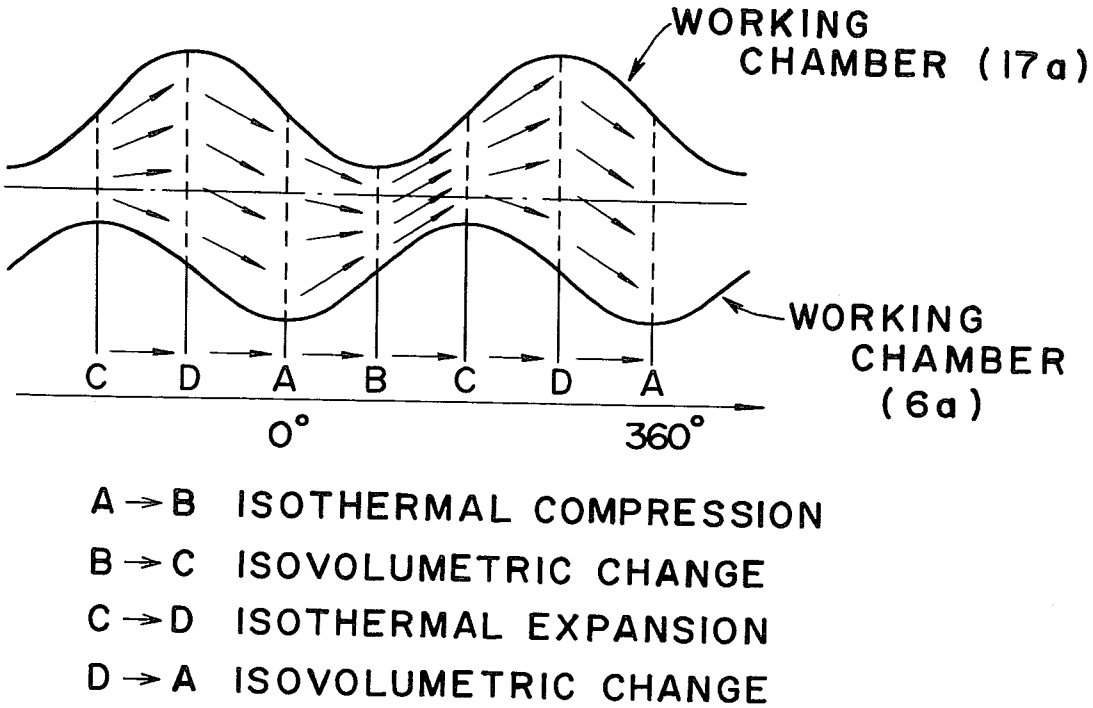
FIG. 5 is a diagram showing the changes in volume in two co-operating chambers.

For example, as shown in FIG. 5, the working chambers 6a and 17a are interconnected in such a manner that the chamber 6a is in co-operation with the chambers 17a which is shifted in phase by about 90° from the co-operating chamber 6a. Thus, referring to a specific working chamber 6a in the housing 4 and the co-operating working chamber 17a in the housing 15, the isothermal compression stroke is conducted in the time interval A through B, the isovolumetric change in B through C, the isothermal expansion in C through D and the isovolumetric change in D through A as shown in FIG. 5.

Referring now to FIG. 6, the operation of the Stirling cycle machine in accordance with the present invention will be described with specific reference to the chamber 6a and the co-operating chamber 17a. The chamber 6a is maintained at a substantially constant temperature by the cooling water circulated in the space 46 and in the cooling water jacket 8.

As the chamber 6a increases in volume in response to the rotation of the rotor 5, the fluid in the system is introduced into the chamber as shown in FIG. 6 (A). As the rotor 5 rotates, the fluid of the chamber 6a is compressed and the fluid therein is forced through the co-operating passage 7a into the heat exchanger 29 (FIG. 6B). In this stage operation, the fluid is cooled by the cooling water in the space 46 and the jacket 8.

The fluid in the passage 7a is then passed from the heat exchanger 29 through the regenerator 23, the passages 23Ga and 18a, the grooves 19a into the passages 21 in the housing 15. In this stage of operation, there is no change in volume of the fluid. Thus, the process produces isovolumetrically. When the machine is operated as an external combustion engine, the housing 15 is heated and the fluid in the passages 21 receives heat from the housing 15. Therefore, the pressure in the fluid is correspondingly increased in this stage of operation. In accordance with a feature of the present invention, since the fluid is passed through a plurality of the passages 21 formed in the housing 15, the fluid can be effectively heated. It should be noted that the extended length of the passages 21 serves to increase the efficiency of the heat exchange and the slide valves 19, 20 are able to employ the extended length of the passages 21.

The fluid is then passed from the passages 21 through the apertures 22 into the chamber 17a which is in the expansion stroke as shown in FIG. 6C. When the machine is operated as an engine, the pressure of the fluid acts on the vane 50 of the rotor to drive the rotor 16. Therefore, the fluid in the expanded chamber 17a is passed again through the regenerator 23 into the heat exchanger 29.

The heat carried by the fluid from the chamber 17a is absorbed by the matrix 25a in the regenerator 23 to be given back to the fluid which comes from the heat exchanger 29 in next operating cycle. Further, the heat is also exchanged between the fluid in the adjacent passages of the regenerator 23 and of the heat exchanger 29.

When the machine is to be operated as a refrigerating unit or a heat pump by rotation of the shaft 1, the fluid absorbs heat from atmosphere when it is introduced into the chamber 17a and isothermally expanded therein and a refrigerating temperature is produced in the housing 15. In this instance, it is preferred to make the volume of the chamber 17a small in relation to that of the chamber 6a. Further, when the chamber 17a is used for compressing and cooling the fluid and the chamber 6a for expanding and heating the fluid, the machine can be operated as a low temperature prime mover.

FIG. 7 shows another embodiment of the present invention in which the fluid passages 21 formed in the rotor housing 15 are substituted by corresponding number of conduits 21′ which may be heated by suitable means when the machine is used as an external combustion engine. The arrangement of the fluid passages 21 or 21′ in accordance with the present invention are advantageous in providing an improved heat absorbing efficiency.

Further, in accordance with the present invention, substantially all of the movable elements are of rotary type so that the machine in accordance with present invention can provide a smooth and quiet operation. The machine in accordance with the present invention has less number of parts as compared with conventional Stirling cycle machine. Thus, the machine is light in weight and compact.

The invention has thus been shown and described with reference to specific embodiments, however, it should be noted that the invention is in no way limited to the details of the illustrated structures and changes and modifications may be made without departing from the scope of the appended claims.

I claim:

1. A Stirling cycle machine comprising first housing means having first cavity means formed therein, first rotor means disposed in said first cavity means in the first housing means for defining first chamber means together with the first housing means, said first chamber means having a volume variable in response to rotation of said first rotor means, second housing means having second cavity means formed therein, second rotor means disposed in said second cavity means in the second housing means for defining second chamber means together with the second housing means, said second chamber means having a volume variable in response to rotation of said second rotor means, means for connecting said first and second rotor means so that they are simultaneously rotated, passage means for connecting the first chamber means with the second chamber means with a predetermined phase difference, regenerator means provided in said passage means, means provided adjacent to the first chamber means for maintaining the first chamber means at a substantially constant temperature, said passage means including a plurality of passages between the regenerator means and the second chamber means.

2. A Stirling cycle machine in accordance with claim 1 in which said first and second chamber means include a plurality of and the same number of first and second working chambers, said passage means including a corresponding number of separated passages which connect the first chambers respectively with the second chamber in different phase positions.

3. A Stirling cycle machine in accordance with claim 2 in which heat exchanger means is provided to place said passages in the passage means in heat exchange relationship.

4. A Stirling cycle machine in accordance with claim 3 in which the heat exchanger means includes a heat exchanger housing which is connected with the first and second rotor means to rotate therewith in unison.

5. A Stirling cycle machine in accordance with claim 3 in which the heat exchanger means includes a heat exchanger housing which is connected with the first and second rotor means to rotate therewith in unison, said heat exchanger housing being disposed in a space formed in said first rotor means for providing jacket means for cooling medium, said heat exchanger housing having spiral ridge means on outer surface whereby the cooling madium in the space is driven by the spiral ridge means as the heat exchanger housing is rotated.

6. A Stirling cycle machine in accordance with claim 1 in which said plurality of passages are formed in the second housing means.

7. A Stirling cycle machine in accordance with claim 1 in which said plurality of passages are formed by conduits disposed outside the second housing means.

8. A Stirling cycle machine in accordance with claim 1 in which said regenerator means is connected with the first and second rotor means to rotate therewith.

9. A Stirling cycle machine in accordance with claim 6 in which said regenerator means includes a portion extending in the said second rotor means, said second housing means comprising an outer and inner housing members between which spaces are formed, said plurarity of passages for communicating said regenerator means with said second chamber means being formed in said portion and said space.

10. A Stirling cycle machine in accordance with claim 9 in which said plurality of the separated passages formed between the outer and inner housing members are at one end brought cylindrically into communication through apertures formed in said inner housing member with the passages formed in said extended portion of said regenerator and at the other end cylindrically into communication through other apertures bored in said inner housing member with said second chamber means.

11. A Stirling cycle machine in accordance with claim 10 in which said passages formed between said outer and inner housing members include off-set portion means to obtain the extended length of heat exchange passages.

* * * * *